United States Patent [19]

Sparks

[11] 4,045,995

[45] Sept. 6, 1977

[54] FLUID-MECHANICAL DRIVE FOR PRESS BRAKE

[75] Inventor: Charles H. Sparks, Eugene, Oreg.

[73] Assignee: Steel Structures, Inc., Eugene, Oreg.

[21] Appl. No.: 626,849

[22] Filed: Oct. 29, 1975

[51] Int. Cl.[2] ..... B21D 7/06

[52] U.S. Cl. ..... 72/450; 72/389; 72/453.03

[58] Field of Search ..... 72/389, 450, 453, 385, 72/386, 453.03; 100/231, 293; 83/380, 390

[56] References Cited

U.S. PATENT DOCUMENTS

| | | | |
|---|---|---|---|
| 542,190 | 7/1895 | Guild | 83/380 |
| 738,787 | 9/1903 | Fogarty | 83/380 |
| 2,738,748 | 3/1956 | Hecht | 72/450 |
| 2,890,649 | 6/1959 | Hodges | 100/231 |
| 3,587,286 | 6/1971 | Fritsch | 72/450 |

*Primary Examiner*—Lowell A. Larson
*Assistant Examiner*—Gene P. Crosby
*Attorney, Agent, or Firm*—Klarquist, Sparkman, Campbell, Leigh, Hall & Whinston

[57] ABSTRACT

A fluid-mechanical drive for a press brake incudes two lever members, pivotally connected between their opposite ends to two corresponding end frame members of the press brake. A pair of hydraulic cylinders pivotally connect one end of each lever member to the upper blade at spaced positions,. The opposite end of each lever member is mechanically connected to the upper blade so that upon simultaneous extension of the two fluid cylinders, a direct downward force is applied to the upper blade at two spaced positions along the blade by such cylinders and a downward reaction force is applied through the lever members and mechanical means to the upper blade at two other spaced positions along the blade to drive such blade downwardly through its working stroke into coaction with a lower blade. In one embodiment, the mechanical means are link members, each pivoted at one end to the upper blade and at the other end to a lever member. In another embodiment, the mechanical means is an eccentric formed as the opposite end of each lever member, with the eccentric being offset from the pivot axis of the lever member and operating within a recess of an upper extension of the upper blade.

8 Claims, 4 Drawing Figures

FLUID-MECHANICAL DRIVE FOR PRESS BRAKE

BACKGROUND OF THE INVENTION

1. Field of the Invention

The present invention relates to a fluid-mechanical drive for a press brake.

2. Description of the Prior Art

According to the conventional press brake construction of the prior art as shown in FIG. 1 of the application drawing, an upper movable, heavy steel blade 10 is moved vertically between an upper retracted position shown and a downwardly extended position for coaction with a stationary lower blade 12 by a pair of hydraulic cylinders 14, 15 connected at one end to stationary upright end frame members 16, 18 and at the other end to end portions of the upper blade. The large forces acting down on the opposite ends of the upper blade 10 require that the central vertical dimensions of such upper blade 10 be substantially greater than the same dimensions at the opposite ends of such blade to minimize blade deflection when the two blades coact against a metal workpiece (not shown) inserted between the upper and lower blades for forming. Lower blade 12 is similarly dimensioned for the same reason. Additional driving cylinders similar to end cylinders 14 and 15 cannot be used at intermediate positions along the movable blade to obviate the deflection problem because the space behind blades between end members must be kept clear of additional support framework to accomodate the workpieces to be formed.

The desirability of eliminating the massive central portion of at least the upper blade member 10 will be apparent, both from the standpoint of cost and weight saving and to better control deflection.

According to one prior suggested solution to the foregoing problem, as shown in prior U.S. Pat. No. 2,890,649, one single-acting central fluid cylinder-piston unit is carried by the upper blade at its midpoint and has an upwardly extensible piston with a pair of pivot links extending upwardly therefrom. The pivot links are pivoted to the inner ends of lever members which extend outwardly in opposite directions along the upper blade from the piston-cylinder unit. The lever members are pivoted to the front faces of upright end frame members and extend outwardly along the blade therefrom. The outer ends of the lever members are then pivotally connected by linkages to the outer ends of the upper blade. Although such a prior construction has some tendency to distribute downward driving forces along the length of the upper blade, it only partially fulfills this objective since it concentrates the applied forces at the midpoint and opposite ends of the upper blade. Furthermore, such prior construction still requires an upper blade with central blade portion of increased vertical dimension to mount the piston-cylinder unit, and a piston-cylinder unit of special construction. Such prior construction additionally requires supplementary fluid retraction cylinders to lift the upper blade to its open position since the primary piston-cylinder unit is single-acting.

Accordingly, there is still a need for a press brake drive which successfully distributes driving forces along the length of the upper blade in a manner which eliminates the need for an upper blade with an enlarged massive central blade portion and which can be accomodated to existing press brakes and their hydraulic systems.

SUMMARY OF THE INVENTION

In accordance with the present invention, an improved fluid-mechanical drive for a press brake eliminates the need for an upper blade with a central upper blade portion of increased mass and dimension. This is accomplished through the use of two double-acting fluid cylinders operating independently two lever members to apply downward driving forces to the upper blade at four spaced-apart positions along the length of the blade, utilizing both the direct and the reaction forces developed by the cylinders upon their extension. The lever members are pivoted between their ends to the front faces of two spaced upright end frame members of the press brake. The two cylinders connect one set of ends of the lever members to the upper blade and mechanical means connect the other set of ends of the lever members to the upper blade. Extension and retraction of the two cylinders reciprocate the upper blade between a raised, open position and a lowered, working position.

A primary object of the invention is to distribute applied working forces along the length of the upper, movable blade of a press brake and thereby eliminate the need for a massive central blade portion of much greater vertical dimension and mass than the end portions in such upper blade.

Another primary object of the invention is to provide an improved fluid mechanical drive for a press brake which minimizes problems of deflection and localized stresses.

Another important object is to provide an improved press brake which is of simplified and economical construction and which is capable of utilizing existing press brake frames and lower blades.

The foregoing and other objects, features and advantages of the invention will become more apparent from the following detailed description which proceeds with reference to the accompanying drawings.

DETAILED DESCRIPTION

Figure 1:
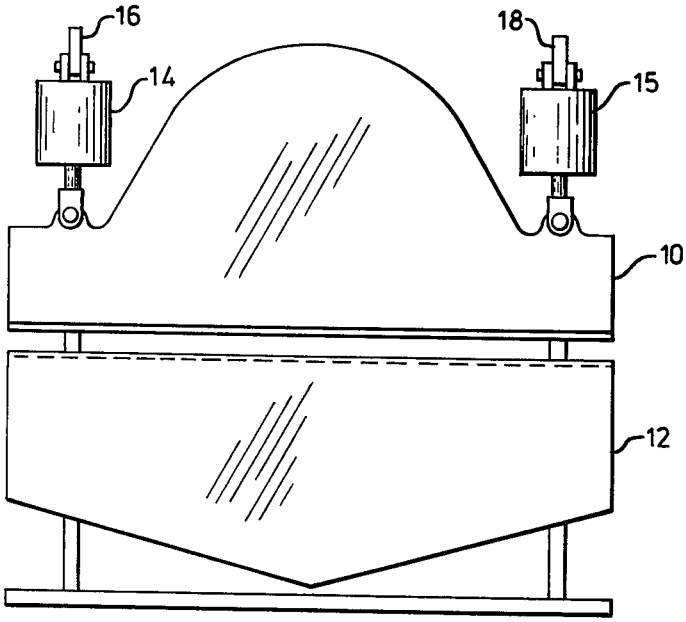
Fig. 1 PRIOR ART
FIG. 1 is a front elevational view of a prior art press brake of conventional construction.

The prior art press brake of FIG. 1 has been described in the preamble hereof.

Figure 2:
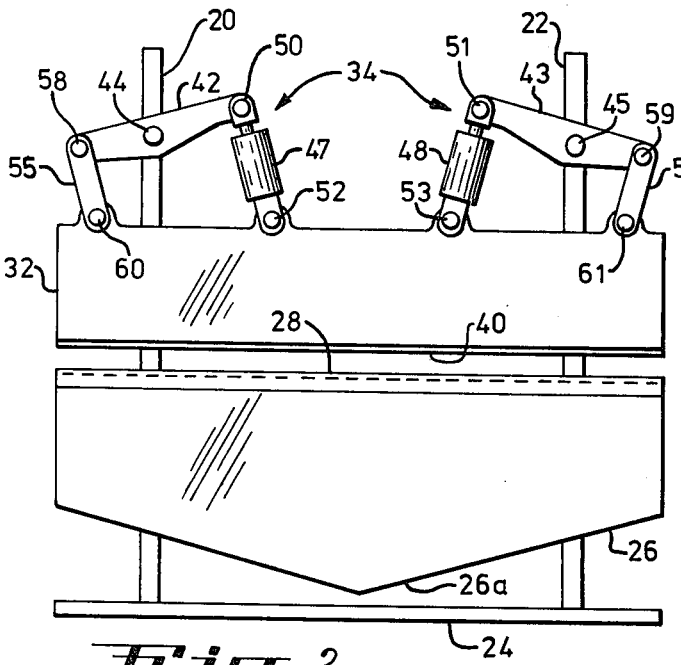
FIG. 2 is a front elevational view of a press brake in accordance with the present invention.

Referring to FIG. 2, the press brake of the invention comprises a pair of horizontally spaced-apart, relatively thin, parallel upright end frame members 20, 22 interconnected by a base frame member 24. As shown best in FIG. 3, the end frame members 20, 22 are provided with generally C-shaped access openings, one of which is shown at 30 in FIG. 3.

A long stationary lower blade member 26 also interconnects the end frame members and spans the space between such members 20, 22 at their front faces. Lower blade members 26 includes a midportion 26a of greater vertical dimension than the opposite end portions of such blade to eliminate problems of deflection as previously discussed. The upper edge of lower blade member 26 forms a die holder which mounts a replaceable lower die member 28.

Figure 3:
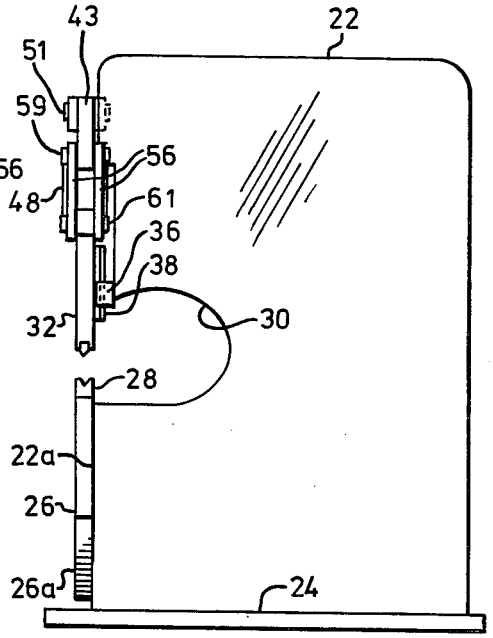
FIG. 3 is a side elevational view of the press brake of FIG. 2.

A long upper blade 32 of uniform vertical dimension throughout its length spans the distance between upright end frame members 20, 22 above and parallel to lower blade 26. Upper blade 32 is mounted for vertical reciprocative sliding movement on the front faces of end members 20, 22. For this purpose guideways 36 on end members 20, 22 receive slide portions 38 of the upper blade as shown in FIG. 3. The upper blade is reciprocated by fluid mechanical drive means indicated generally at 34 and carried by end frame members 20, 22. The lower edge of upper blade 32 serves as a die holder for mounting a removable upper die member 40 adpated to coact with lower die member 28 in forming sheet metal workpieces placed between the two die members.

Fluid-mechanical drive 34 includes a pair of lever members 42, 43, above upper blade 32. The lever members are pivotally mounted between their opposite ends at the front faces of end frame members 20, 22 on pivot shafts 44, 45 for pivotal movement about a horizontal pivot axis extending normal to the length dimension of the upper blade. A pair of extensible fluid cylinder means, in this case hydraulic piston-cylinder units 47, 48, pivotally connect the lever members 42, 43 to upper blade 32. More specifically, cylinders 47, 48 are pivotally connected at their upper ends at pin connections 50, 51 to the inner ends of lever members 42, 43, respectively, and are pivotally connected at their lower ends at pin connections 52, 53 to an upper edge portion of upper blade 32 at two spaced positions along the upper blade.

The outer ends of lever members 42, 43 are operatively connected by mechanical means to upper blade 32 at a second two spaced positions along the upper blade, both of which are also spaced from the cylinder connections to such blade. Such mechanical connecting means in the embodiment of FIGS. 2 and 3 comprise link members 55, 56. The upper ends of such link members are connected at pin connections 58, 59 to the outer ends of lever members 42, 43, respectively. The lower ends of the same link members 55, 56 are connected at pin connections 60, 61 to outer end portions of upper blade 32. Preferable the four positions at which links 55, 56 and cylinders 47, 48 are connected to blade 32, as represented by pin connections 60, 52, 53 and 61, are substantially equally spaced along the length of such blade. In this way the applied downward driving forces will be applied equally along the length of the blade, thereby minimizing any tendency of the upper blade to deflect during the work-forming phase of its stroke.

Cylinders 47 and 48 are supplied with hydraulic pressure fluid from a conventional source (not shown) through suitable hydraulic supply and return hoses. Cylinders 47, 48 are double-acting, serving both to extend and retract the upper blade with respect to stationary lower blade 26.

In operation, with a workpiece (not shown) supported on lower die 28 and with the upper blade in its retracted position shown, cylinders 47 and 48 extend simultaneously to apply downward driving forces directly through pin connections 52, 53 to the upper blade. Simultaneously, reaction forces of the cylinder pistons, acting through pin connections 50, 51 are applied upwardly to the inner ends of lever members 42, 43. These upward reaction forces are converted by the lever members to downward forces at their outer ends. These downward reaction forces are applied through pin connections 58, 59, link members 55, 56 and finally pin connections 60, 61 to the outer ends of blade 32. The four downward driving forces thus developed are applied equally along the length of the upper blade to move the blade downwardly into working cooperation with lower blade 26 whereby upper and lower dies 40, 28 coact to form the workpiece. At the end of the downward working stroke of the upper blade, cylinders 47, 48 retract simultaneously, lifting upper blade 32 to its raised open position shown, through a reversal of the combination of direct and reaction forces previously described.

In practice, it will usually be desirable to have the inwardly extending arm portions of lever members 42, 43 be of greater length than their outer arm portions to an extend such that the downward forces applied to the outer ends of blade 32 will approximately equal the downward forces applied to the intermediate portions of such blade, after overcoming frictional forces in the linkage system itself. Preferably also, cylinders 47, 48 and linkages 55, 56 are mounted at inclinations to the vertical when upper blade 32 is in its retracted position shown in FIG. 2 to an extent such that maximum downward driving forces are developed by the drive system when upper blade 32 reaches or approaches the lower end of its working stroke. This occurs when the cylinders and link members approach the vertical as the blade descends.

FIG. 4 EMBODIMENT

Figure 4:
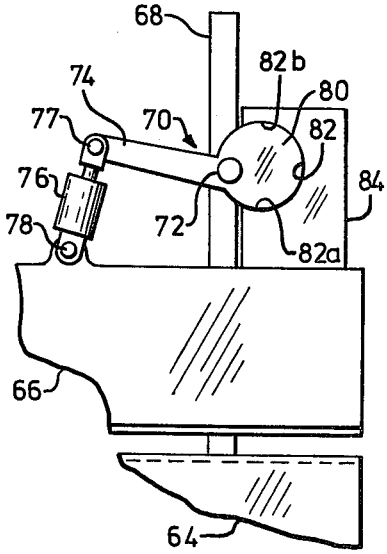
FIG. 4 is a partial front elevational view of a modified form of press brake drive in accordance with the present invention.

FIG. 4 shows a modified form of hydromechanical drive for a press brake having a stationary lower blade 64 and vertically movable upper blade 66 and upright end frame members 68, similar to those shown in FIGS. 2 and 3. In fact, the only difference between the press brakes of FIGS. 2 and 4 are the mechanical portions of their respective drive means.

In the embodiment of FIG. 4 the drive means for each side of upper blade 66 comprises a lever member 70 pivotally connected by a pivot shaft 72 to the front face of upright end member 68. A long inwardly extending arm portion 74 of the lever member 70 is pivotally connected at its outer end to upper blade 66 by a hydraulic cylinder 76 through upper and lower pin connections 77, 78, respectively. The opposite end portion of lever member 70 is an enlarged eccentric portion 80 offset outwardly of pivot shaft 72 about which the eccentric rotates. Eccentric portion 80 is received within a correspondingly shaped recess 82 of an upward extension 84 of upper blade 66.

Upon extension of cylinder 76 a direct downward driving force is applied through pin connection 78 to upper blade 66. At the same time, a reaction force is applied to lever member 70 through pin connection 77, tending to rotate the lever member about its pivot shaft 72 to apply a downward reaction force through eccentric 80 to approximately point 82*a* of blade extension 84. Thus downward driving forces are applied to the upper blade, both at point 78 and at point 82*a.* Of course, an identical driving arrangement is provided at the opposite side (not shown) of blade 66 so that four driving forces are applied to the upper blade, preferably at equally spaced positions along the blade. Also, preferably the distance between pivot shaft 72 and the inner end of lever member 70 and the corresponding distance between the pivot shaft and the point of application of the reaction force at 82*a* are determined so as to develop equal forces at 78 and 82*a* acting on the upper blade during its working stroke.

Upon retraction of cylinder 76, an upper portion of eccentric 80 applies an upwardly directed force to a point at approximately 82*b* of blade extension 84. At the same time an upward force is applied at pin connection 78, retracting the upper blade from lower blade 64.

Having illustrated and described the principles of my invention by what are presently two preferred embodiments, it should be apparent to those skilled in the art that my invention can be modified in arrangement and detail without departing from such principles. I claim as my invention all such modifications as come within the true spirit and scope of the following claims.

I claim:

1. In a press brake having a fixed lower blade and die and a cooperative vertically movable upper blade and die, upright end frames for supporting said blades, and drive means for said upper blade, the improvement comprising:

a pair of lever members, one pivoted intermediate its opposite ends to each said end frame member above said upper blade for movement about a horizontal pivot axis normal to the length dimension of said upper blade, a pair of extensible and retractable fluid cylinder means pivotally interconnecting one end portion of each said lever member and said upper blade at a first set of two spaced positions along said upper blade, and mechanical means operably interconnecting the opposite end portion of each said lever member and said upper blade at a second set of two spaced positions along said upper blade which are spaced along said upper blade from said first two positions such that upon extension of said pair of cylinder means a downward driving force is applied to said upper blade and upon retraction of said pair of cylinder means an upward force is applied to said upper blade at four spaced-apart positions along the length of said upper blade, said four positions being substantially equally spaced apart along the length of said upper blade so as to equalize the downward forces applied to said upper blade upon extension of said pair of extensible cylinder means, and said upper blade having a substantially uniform vertical dimension of minimum height throughout its length whereby said four positions adequately support said blade from bending in use.

2. In a press brake according to claim 1, said mechanical means comprising a pair of link members, one pivotally interconnecting said opposite end of each said lever member and said upper blade.

3. In a press brake according to claim 1, said pair of cylinders and said mechanical means being connected to said upper blade at said four positions at point connections.

4. In a press brake having a fixed lower blade and die and a cooperative vertically movable upper blade and die, upright end frames for supporting said blades, and drive means for said upper blade, the improvement comprising:

a pair of lever members, one pivoted intermediate its opposite ends to each said end frame member above said upper blade for movement about a horizontal pivot axis normal to the length dimension of said upper blade, a pair of extensible fluid cylinder means, one pivotally interconnecting one end portion of each said lever member and said upper blade at a first set of two spaced positions along said upper blade, and mechanical means operably interconnecting the opposite end portion of each said lever member and said upper blade at a second set of two spaced positions along said upper blade which are spaced along said upper blade from said first two positions such that upon extension of said pair of cylinder means a downward driving force is applied to said upper blade and upon retraction of said pair of cylinder means an upward force is applied to said upper blade at four spaced-apart positions along the length of said upper blade, said mechanical means comprising an opposite end portion of each said lever member operably engaging said upper blade portion, said opposite end portion forming an eccentric with respect to its said pivot axis, said eccentric being received within a recess within an upward extension of said upper blade portion.

5. A press brake comprising:

a pair of horizontally spaced-apart narrow upright end frame members, a fixed lower blade and die member supported on said end frame members at the front faces of said frame members and extending therebetween, a vertically movable upper blade and die member extending parallel to and above said lower blade and die between said end frame members at said front faces, drive means for moving said upper blade and die member vertically toward and away from said lower blade and die member for cooperation therewith, a pair of lever members, one of said lever members being pivotally connected to a front face of one said end frame member above said upper blade and die member and the other said lever member being pivotally connected to the front face of the other said end frame member above said upper blade and die member, the pivotal axes of rotation of said lever members being positioned between the opposite ends thereof so that a first arm portion of each said lever member extends inwardly of its associated said upright end frame member along said upper blade and a second arm portion of each said lever member extends outwardly of its associated said end frame member along said upper blade member, a pair of extensible double-acting fluid cylinder means, one said cylinder means being pivotally connected at one end thereof to one said arm portion of one said lever member and having the opposite end thereof pivotally connected to said upper blade member, the other said cylinder means being pivotally connected at one end thereof to one arm portion of the other said lever member and being pivotally connected at the other end thereof to said upper blade, the other arm portion of each lever member being mechanically connected to said upper blade member such that upon simultaneous extension of said pair of fluid cylinder means a direct downward driving force is applied by said pair of cylinder means to said upper blade member at first spaced positions along said upper blade, and a downward reaction force is applied by said mechanical means to said upper blade member at second spaced positions along said upper blade spaced from said first positions to drive said upper blade toward said lower blade, said first and second positions all being substantially equally spaced apart along the length of said upper blade and offset from the center of said upper blade, said upper blade member having a substantially uniform depth dimension of minimum height as measured from the bottom to the top edge thereof along its length whereby said four positions adequately support said blade from bending in use.

6. A press brake according to claim 5 wherein said pair of cylinder means and said mechanical means are arranged to apply a maximum downward driving force to said upper blade member near the lower limit of movement of said upper blade.

7. A press brake according to claim 5 wherein said pair of cylinder means are connected to said inwardly extending first arm portions of said lever members.

8. A press brake according to claim 7 wherein said inwardly extending first arm portions are of greater length than said outwardly extending second arm portions.

* * * * *

UNITED STATES PATENT OFFICE

CERTIFICATE OF CORRECTION

Patent No. 4,045,995 Dated Sept. 6, 1977

Inventor(s) Charles H. Sparks

It is certified that error appears in the above-identified patent and that said Letters Patent are hereby corrected as shown below:

On the cover page, the figure shown should be Fig. 2 rather than Fig. 1 as shown.

Column 2, line 66; "members" should be --member--;
Column 3, line 16; "adpated" should be --adapted--;
Column 3, line 46; "Preferable" should be --Preferably--;
Column 4, line 18; "extend" should be --extent--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*